United States Patent [19]

Wax

[11] 4,087,144

[45] May 2, 1978

[54] PORTABLE BOOTH

[75] Inventor: Miriam P. Wax, Narberth, Pa.

[73] Assignee: Consumer Idea Centers, Inc., Haverford, Pa.

[21] Appl. No.: 710,779

[22] Filed: Aug. 2, 1976

[51] Int. Cl.[2] ..... A47B 43/00

[52] U.S. Cl. ..... 312/258; 312/239; 312/140.2; 52/36

[58] Field of Search ..... 312/258, 140.1, 239; 52/71, 35

[56] References Cited

U.S. PATENT DOCUMENTS

| | | | |
|---|---|---|---|
| 447,239 | 2/1891 | Babcock et al. | 312/258 X |
| 460,344 | 9/1891 | O'Connell | 312/262 |
| 747,741 | 12/1903 | Marsh | 312/140.2 |
| 1,474,864 | 11/1923 | Vogt et al. | 52/36 |
| 2,401,226 | 5/1946 | Calvert | 312/239 UX |
| 2,890,498 | 6/1959 | Bigelow | 52/71 X |
| 3,224,489 | 12/1965 | Haberthier | 52/71 X |
| 3,226,776 | 1/1966 | Van Wormer | 52/36 |
| 3,841,037 | 10/1974 | Clark | 52/71 |

FOREIGN PATENT DOCUMENTS

| | | | |
|---|---|---|---|
| 696,097 | 12/1930 | France | 52/36 |

*Primary Examiner*—Paul R. Gilliam
*Assistant Examiner*—V. N. Sakran
*Attorney, Agent, or Firm*—Seidel, Gonda & Goldhammer

[57] ABSTRACT

The portable booth is comprised of a front wall and two side walls, to thereby define a three-sided structure. The front wall has an opening and a shelf attached thereto adjacent the lower edge of the opening. The booth is collapsible and adapted to be used for in-store demonstrations of products, cooking techniques, etc.

4 Claims, 5 Drawing Figures

PORTABLE BOOTH

SUMMARY OF THE INVENTION

The portable booth of the present invention has an upright front wall and a pair of upright side walls. Each side wall is connected to an edge portion of the front wall on the same side thereof to thereby define a three-sided structure.

The front wall has an opening therein. A shelf is supported by the front wall at an elevation of about 3 to 4 feet from the lower edge of the front wall. The shelf has a length corresponding generally to the width of the front wall.

A booth constructed in accordance with the present invention is portable and preferably constructed so as to be collapsible. The booth may be used for a variety of purposes including the dispensing of beverages, for in-store demonstrations to customers of cooking techniques, education, etc. When used for in-store demonstrations, the products being demonstrated or at that time on sale in the store may be exhibited on the shelf. The front wall opening is sufficiently large so as to facilitate observation of the upper half of a hostess or demonstrator. The front wall opening may be provided with curtains or other decorative ornamentation.

It is an object of the present invention to provide a novel portable booth for in-store demonstrations, for use at conventions, etc.

Other objects will appear hereinafter.

For the purpose of illustrating the invention, there is shown in the drawings a form which is presently preferred; it being understood, however, that this invention is not limited to the precise arrangements and instrumentalities shown.

Referring to the drawing in detail, wherein like numerals indicate like elements, there is shown a portable booth in accordance with the present invention designated generally as 10.

Figure 1:
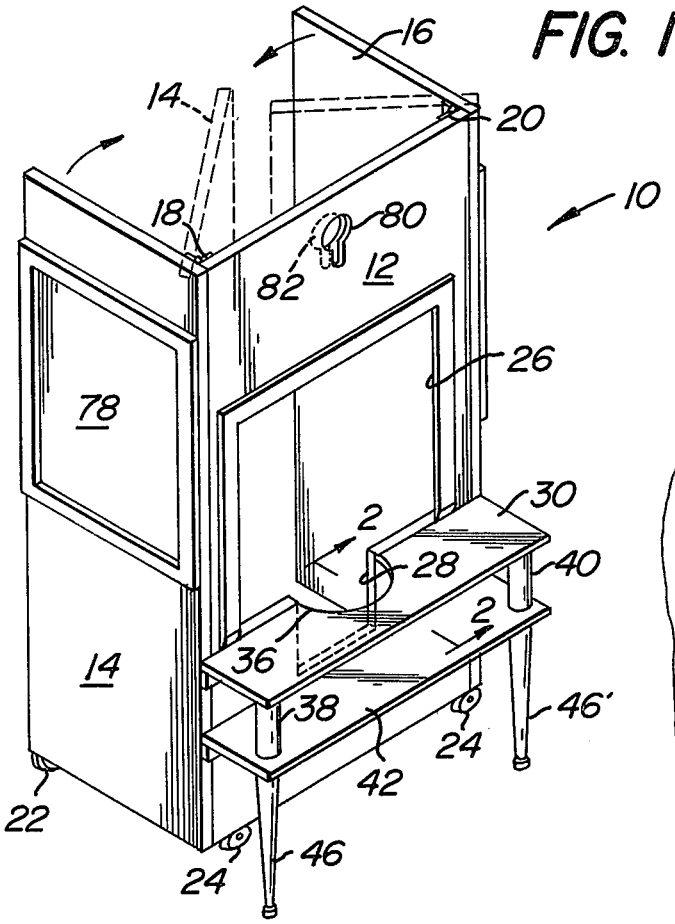
FIG. 1 is a perspective view of a booth in accordance with the present invention.

The booth 10 includes an upright or vertically disposed front wall 12. Side walls 14 and 16 are provided. Side wall 14 is connected to the front wall 12 adjacent a side edge portion thereof by way of a piano hinge 18. Side wall 16 is connected to an opposite side edge portion of front wall 12 by way of piano hinge 20.

The walls 12, 14 and 16 in their solid line position constitute the operative arrangement of the walls thereby defining a three-sided structure. The walls 14 and 16 are adapted to be latched in their solid line position in any convenient manner using a conventional latch. The hinges 18 and 20 facilitate pivoting the side walls 14 and 16 to a collapsed position. A partially collapsed position is indicated by the phantom illustration of side walls 14 and 16.

The side walls 14 and 16 preferably have the same height as the front wall 12. I have found that a suitable height is 7 feet to 8 feet. I prefer to make the front wall 12 4 feet wide with the side walls 14 and 16 having a width of 2 feet. Hence, in the collapsed position of the booth 10, each of the side walls 14 and 16 is parallel to the front wall 12. To facilitate the easy movement of the booth 10 as a unit and to facilitate manipulation of the side walls 14 and 16 to their collapsed position, wheels 22 are attached to the lower edge portion of side walls 14, 16 and wheels 24 are attached to the lower edge portion of front wall 12. The wheels 22, 24 may be any one of a variety of commercially available wheels, but preferably are swivel caster wheels.

The front wall 12 is provided with a opening 26 of substantial size. I prefer to make the opening 26 in the form of a square with each side being approximately 3½ feet. A second opening 28 is provided in the front wall 12. Opening 28 is smaller than opening 26 and is contiguous with the lower end of opening 26. Opening 28 may be considered an extension of opening 26. Typical dimensions for opening 28 may be 1 foot by 1 foot.

Figure 2:
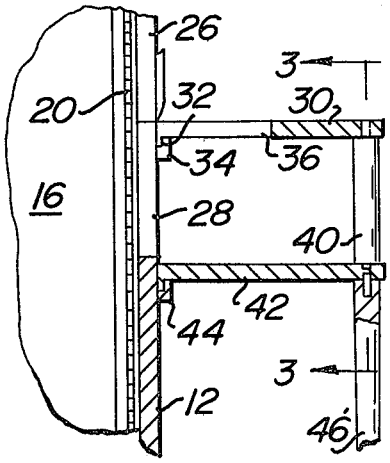
FIG. 2 is a sectional view taken along the line 2—2 in FIG. 1.
Figure 3:
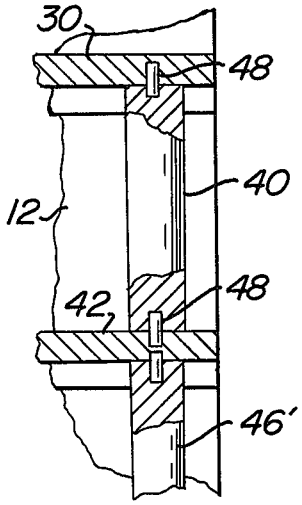
FIG. 3 is a sectional view taken along the line 3—3 in FIG. 2.

One or more shelves are connected to the front wall 12 at or adjacent to the lower edge of the opening 26. As shown in FIGS. 1 and 2, a first shelf 30 is provided with a tab 32 supported by bracket 34 on the front wall 12. Shelf 30 is horizontally disposed and is provided with a notch 36 coextensive with the upper end of notch 28. The free edge of the shelf 30 remote from the front wall 12 is supported by legs 38, 40 removably connected thereto and removably connected to a second shelf 42.

The horizontally disposed shelf 42 is coextensive with the shelf 30. Each of the shelves 30 and 42 extend across substantially the full width of the front wall 12. One side edge of shelf 42 is supported by bracket 44 on the front wall 12. The opposite side edge of shelf 42 is supported by legs 44, 46.

Each of the legs 38, 40 are removably innerconnected with the shelves 30, 42 by pins 48 which extend into blind holes on the leg and shelves. Also, the shelf 42 is removably connected to its legs 46, 46' by similar pins. Each of the shelves 30, 42 is removably supported by their respective brackets. As a result thereof, the shelves are readily removably and collapsible for transportion and/or storage.

Figure 4:
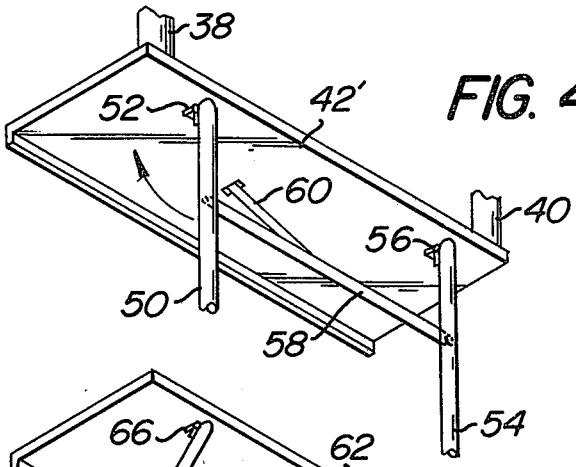
FIG. 4 is a perspective view of an alternative shelf.

In FIG. 4, there is illustrated an alternative embodiment for the shelf 42 and its supporting legs. Thus, the shelf 42' is provided with legs 50, 54. Leg 50 is pivotably connected to the bottom surface of shelf 42' by way of a hinge 52. Leg 54 is pivotably connected to the bottom surface of shelf 42' by hinge 56. A cross bar 58 extends between the legs 50, 54 and is pivotably connected to one end of a strut 60. The other end of strut 60 is removably received in a notch or blind hole on the bottom surface of shelf 42'.

Figure 5:
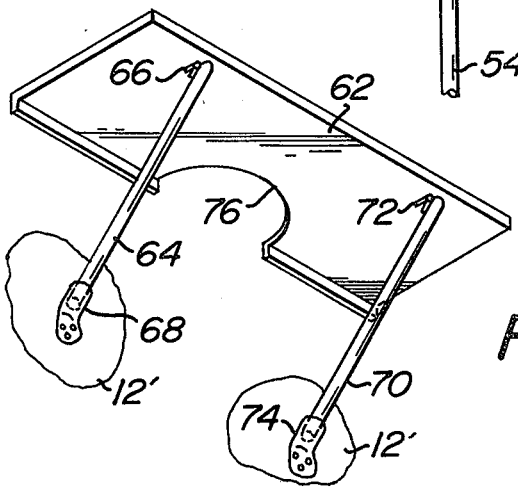
FIG. 5 is a perspective view of another alternative shelf.

In FIG. 5 there is illustrated an alternative shelf 62 which may be substituted for the shelves 30, 42. Shelf 62 is provided with a tab portion adapted to be removably received by the bracket 34. In connection with this embodiment, the front wall of the booth is designated 12' and is provided with sockets 68 and 74 on its front surface adjacent the lower end thereof.

The shelf 62 is provided with a leg 64 pivotably connected at its upper end to the bottom surface thereof by a hinge 66. The free end of leg 64 is adapted to be received in the socket 68. Shelf 62 includes a second leg 70 having its upper end pivotably connected to the lower or bottom surface of shelf 62 by way of hinge 72. The free end of leg 70 is adapted to be received in the socket 74. The side edge of shelf 62 adapted to be juxtaposed to the front wall 12 is provided with a notch 76 adapted to be coextensive of the upper end of the opening 28.

One or both of the side walls 14 and 16 are adapted to have means thereon to facilitate a writing surface 78. Surface 78 may be in the form of a blackboard which is easily erasable and supported by the side wall. The side walls 14 and 16 may be made of the same material as the front wall 12 such as veneered ½ inch plywood. The side walls 14 and 16 may be made of sheet metal such as steel having a coating thereover of a material such as porcelain whereby the porcelain coating will constitute the writing surface.

An opening 80 is provided in the front wall 12 above the opening 26. The opening 80 is in the shape of a light bulb. A light bulb 82 is supported on the inside surface of wall 12 opposite the opening 80. Bulb 82 may operate continuously or intermittently and operates to gain the attention of persons in the immediate area.

Decorative ornamentation in the form of curtains or the like may be attached to the front wall 12 around the opening 26. Also, an awning may be provided over the upper end of the opening 26.

One use of the booth 10 is as follows. The booth 10 is installed in a store such as a supermarket. Items sold by the store and currently on sale are exhibited on shelf 42. A microwave oven and/or hot plate are supported on shelf 30. A hostess stands inside the booth 10. The hostess distributes literature on recipes and other helpful hints related to the items on sale and exhibited on shelf 42. Also, the hostess may prepare food in accordance with the recipes using the oven, hot plate and/or mixer supported on shelf 30. The openings 28, 36 facilitate the hostess being able to bend over and attain access to items on shelf 42.

When the booth 10 is not being utilized by a hostess, it is easily moved to a storage area. If desired, the booth 10 may be collapsed by pivoting the side walls 14, 16 so as to be parallel to the front wall 12. Also, the shelves 30, 42 may be removed and disassembled from their legs. As a result thereof, the booth 10 when being stored occupies a minimum amount of floor space and does not constitute a hazard to personnel seeking to walk along the aisles of the supermarket. Another advantage of the collapsible and/or removable feature of the components of the booth 10 is the ease with which it may be transported to and from a particular store. Thus, all of the components of a booth 10 are easily accommodated in a station wagon.

While the booth 10 has been described above in connection with one use in connection with a supermarket, there are many other uses for the booth 10. For example, the booth 10 may be utilized in connection with charity bazaars for selling of tickets on prizes exhibited on the shelves 30, 42, may be used as a portable bar for the dispensing of beverages at parties and social engagements, etc.

The writing surface 78 should be easily erasable and may contain information of a general nature. The surface 78 preferably contains information related to the goods on the shelves such as the identity of the goods and the sale price. If desired, one or more removable shelves may be provided on the inner surface of wall 12 for storing literature, recipes, etc.

The present invention may be embodied in other specific forms without departing from the spirit or essential attributes thereof and, accordingly, reference should be made to the appended claims, rather than to the foregoing specification as indicating the scope of the invention.

I claim:

1. A portable booth comprising an upright front wall having a forward and a rear face, a pair of upright side walls, each side wall having at least one wheel on the lower end thereof, each side wall being pivotably connected to an edge portion of said front wall on the same side thereof and being generally perpendicular to the front wall and extending rearwardly thereof in an open position so as to thereby define a three-side structure, the transverse dimension of the side walls being approximately one-half the transverse dimension of the front wall, said side walls being pivotable between their open position generally perpendicular to the front wall and a collapsed position generally flush with said rear face of said front wall, said front wall having a first opening therein, a second opening having a width less than the first opening, said second opening extending downwardly from said first opening, and at least one shelf removably supported along one of its edges by a ledge extending from said forward face of said front wall and by at least one leg pivotably secured to the bottom surface of said shelf at one of its ends and said leg being supported by a means on the forward face of said front wall at its other end, said shelf being horizontally disposed at an elevation adjacent the lower end of said opening and extending forwardly of said front wall, said shell having a length corresponding generally to the width of said front wall, said shelf having a notch, said notch being aligned with said second opening and having its ends contiguous with the upper end of said second opening.

2. A portable booth in accordance with claim 1 including a writing surface on the outside face of at least one of said side walls.

3. A portable booth in accordance with claim 1 wherein the width of said opening is at least 50% of the width of the front wall and the lower edge of said opening is about three feet to four feet from the lower end of said front wall, said shelf having legs pivotably connected thereto.

4. A portable booth in accordance with claim 1 wherein said front wall is provided with a pair of superimposed shelves, each shelf being supported from below by legs, each shelf being movably connected to its legs, and each shelf being supported along one edge by said front wall.

* * * * *